United States Patent [19]

Lindmark

[11] 4,077,248

[45] Mar. 7, 1978

[54] RAIL STRAIGHTENING PRESS

[75] Inventor: Karl Lewis Lindmark, Rockford, Ill.

[73] Assignee: Chemetron Corporation, Chicago, Ill.

[21] Appl. No.: 756,197

[22] Filed: Jan. 3, 1977

[51] Int. Cl.[2] ..... B21D 7/06

[52] U.S. Cl. ..... 72/389

[58] Field of Search ..... 72/389, 384, 385, 386, 72/380, 390

[56] References Cited

U.S. PATENT DOCUMENTS

| | | | |
|---|---|---|---|
| 1,337,587 | 4/1920 | Bennett | 72/389 |
| 1,837,040 | 12/1931 | Gross | 72/389 |
| 3,295,350 | 1/1967 | Clayborne | 72/389 |
| 3,848,450 | 11/1974 | Dehlbom | 72/389 |
| 3,881,341 | 5/1975 | Evans | 72/389 |

*Primary Examiner*—C. W. Lanham
*Assistant Examiner*—Gene P. Crosby
*Attorney, Agent, or Firm*—Nicholas M. Esser

[57] ABSTRACT

A press for straightening a railroad rail formed by the welding of the ends of two rail sections together. The press has a first reciprocatable cage having two opposed rams straddling the rail for straightening the rail in one plane and a second reciprocatable cage having similarly arranged rams extending into the first cage for straightening the rail in a second plane. The cages are connected to suitable power means located remote from the tending side of the press for efficient operation of same.

7 Claims, 5 Drawing Figures

RAIL STRAIGHTENING PRESS

BACKGROUND OF THE INVENTION

1. Field of the Invention

This invention pertains to railroad rail straightening presses.

2. Description of the Prior Art

A conventional rail straightening press utilizes a pair of vertically-oriented, opposed, upper and lower hydraulic cylinders for straightening kinks or bends in the rail developed during the rail butt-welding process. Also, a part of the press is a pair of opposed hydraulic cylinders located in a horizontal plane for straightening rail bends developed therein. All cylinders have their lines of action in the center of press and generally adjacent the welded joint. Straddling the line of action of each cylinder are opposed anvils which provide the resistance as each cylinder moves the rail thereagainst. The operation of the press is essentially manual with the operator activating the cylinders as needed via suitable valves from a tending station in the general vicinity of the weld. Suitable gauges are used to determine the extent of the bend developed in the rail and the correct alignment after remedial action.

The above-described press has provided fairly satisfactory operation, but requires an unduly large number of elements. Also, the location of the cylinders, wherein the pistons reciprocate from end to end in the usual fashion, prevents the location of an operator tending station generally adjacent the weld for efficient press operation.

SUMMARY OF THE INVENTION

Applicant, as a consequence, designed a press that reduces the number of elements involved and provides an operator tending station adjacent the rail weld which is located adjacent the center of the machine with hydraulic and electrical controls readily available for use upon determining the rail misalignment resulting from the butt-welding process. Specifically, Applicant deleted a horizontal and a lower vertical cylinder to provide an operator tending station on one side of the machine. Inasmuch as the function of the deleted cylinders is still required, Applicant provides a horizontal cage that is connected to the horizontal cylinder on the side of the machine opposite the tending side that has a pair of opposed rams that straddle the rail and, upon reciprocation, bend the rail in either direction against suitable anvils in a horizontal plane. The single cylinder provides the cage reciprocation since the piston is normally maintained in a central or neutral position of the cylinder wherein the rail can move through the cage until straightening is required. Activation of the piston in either direction from the neutral point causes the rams to contact the rail as desired.

For vertical straightening, Application provides a vertical cage that is connected to the piston of the upper, single vertical cylinder. The vertical cage also has opposed rams that straddle the rail and upon reciprocation bend the rail in either direction against suitable anvils in a vertical plane. Because of the desired location of the cages, generally at the weld and in the center of the machine, the vertical cage straddles the horizontal cage and the vertical rams also extend into the horizontal cage to contact the rail extending therethrough. As with the horizontal rails, the piston of the vertical cylinder is normally maintained in a central or neutral position of the cylinder so that the rod can move the cage in either direction. Thus only two cylinders instead of four are required for the same function and, particularly the removal of a horizontal cylinder, provides space for a tending station for efficient operation of the press. The hydraulic system for the cylinders is also utilized via a hydraulic motor to rotate a sprocket and by a suitable chain, to move the press along lower rails to position the press as desired along the welded rail. This control also is located at the tending station.

It is, therefore, an object of this invention to provide a new and improved rail straightening press.

Another object of this invention is to provide a press having fewer elements.

Still another object of this invention is to provide a press having fewer elements and which utilizes the resulting space to provide an operator tending station specifically located for efficient press operation.

DESCRIPTION OF THE PREFERRED EMBODIMENT

Figure 1:
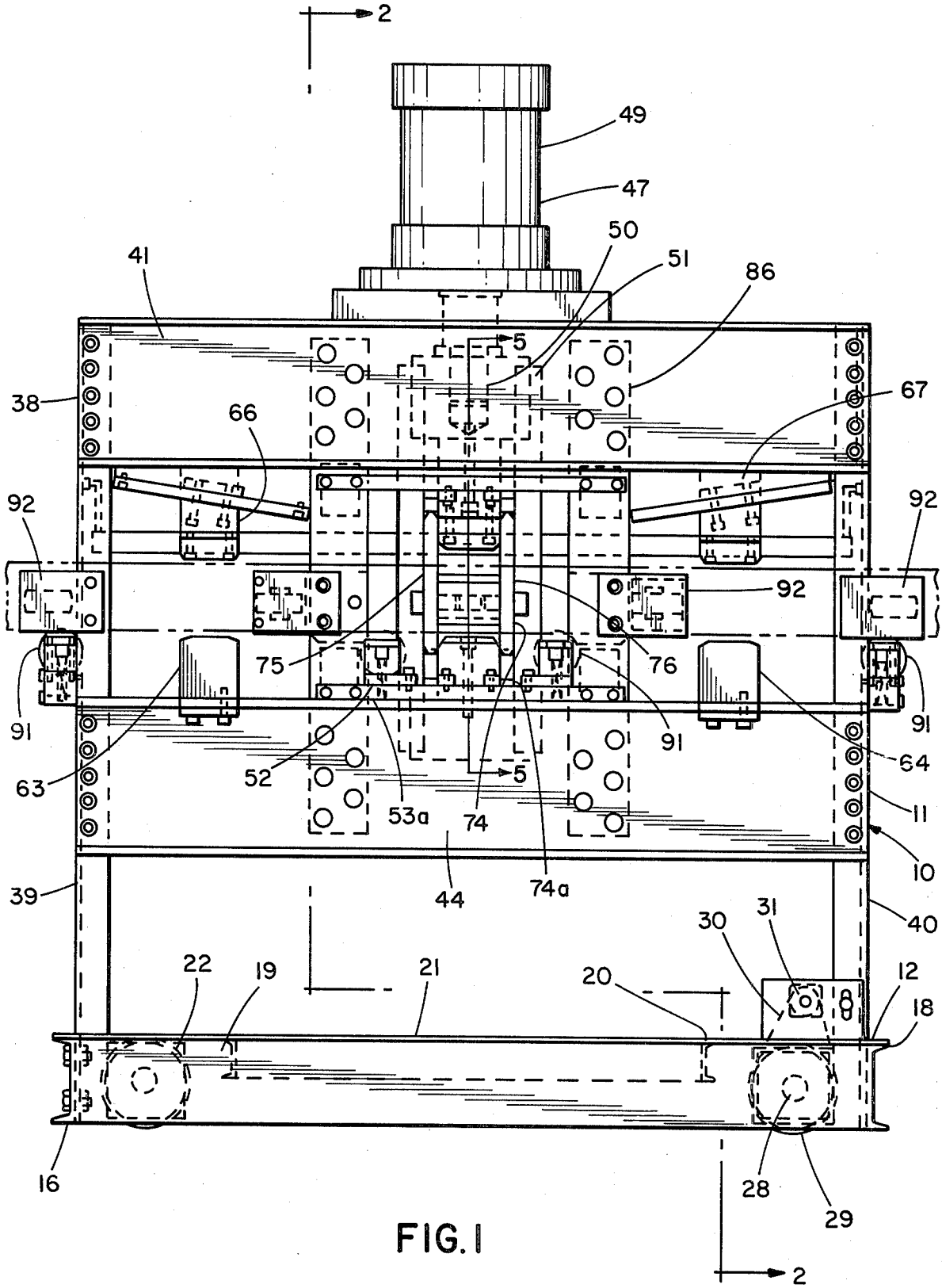
FIG. 1 is a front elevational view of the tending side of the rail straightening press of this invention.
Figure 2:
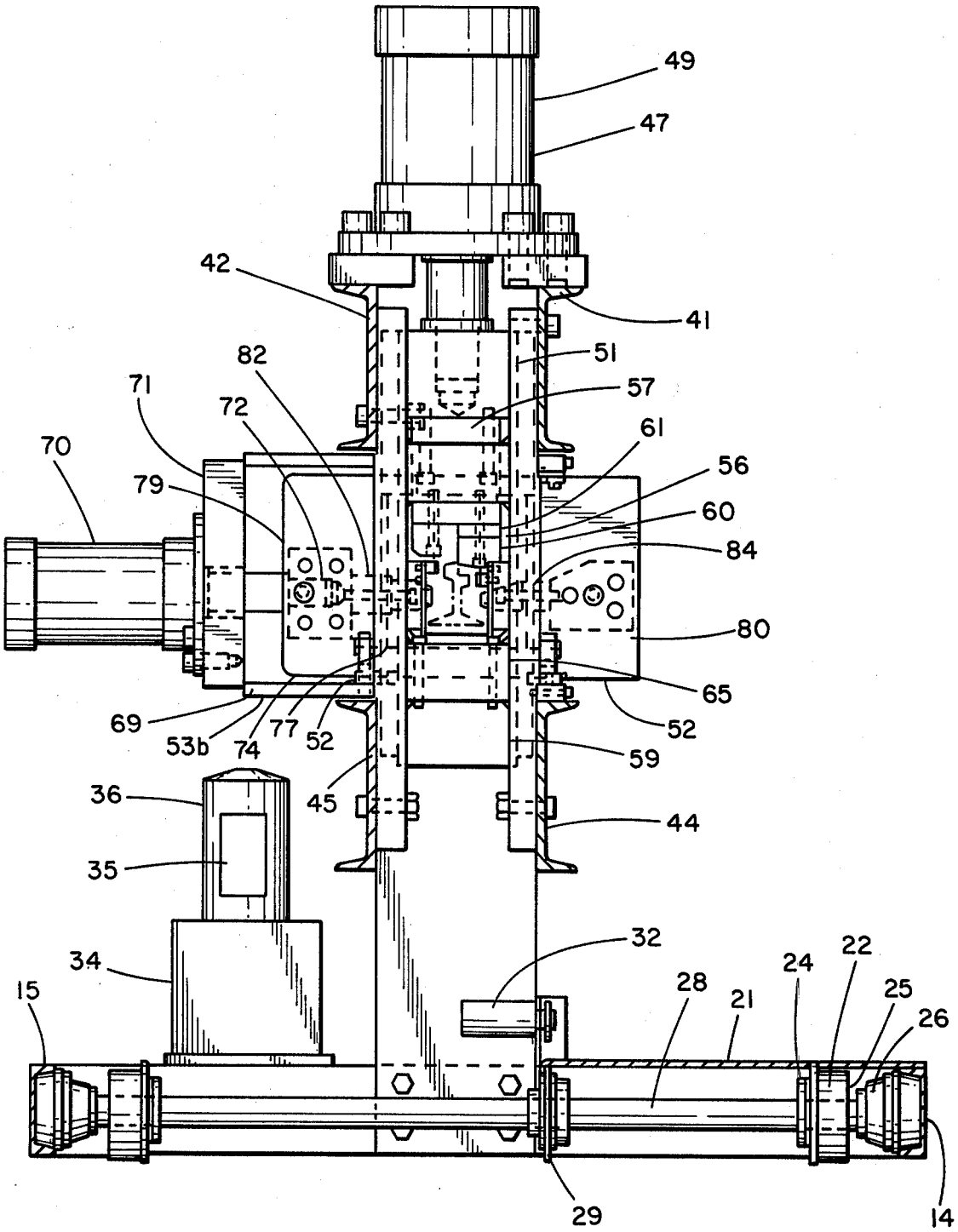
FIG. 2 is an elevational sectional view taken along line 2—2 of FIG. 1.

Referring to FIGS. 1 and 2, 10 indicates a rail straightening press. Press 10 has a rigid support structure 11 on which are mounted all of the press components. Structure 11 includes a generally rectangular base 12. Base 12 comprises a front, rearwardly facing, channel 14, a similar rear channel 15, an outwardly facing left side channel 16, and a right side channel 18. All of the base channels are suitably welded to provide a rigid, box-like structure. Providing internal support to base 12 are smaller, left and right side channels 19 and 20 extending from the front to the rear of the base. Deck plate 21, attached by suitable fasteners to base 12 and spanning channels 16 and 18, provides a press tending station.

Affixed in each corner of base 12 are wheels 22. Wheels 22 support the base for movement on suitable rails to position base 12 and hence, press 10, as needed for location thereof relative to a welded rail to be straightened. Wheels 22 via bushings 24 and keys 25 are supported on base 12 by flange type bearings 26 affixed thereto. Suitable electrical insulators insulate the wheels and therefore the base from the rails.

A hydraulic drive is provided for base 12 and therefore press 10 via wheels 22. As shown best in FIG. 1, drive axle 28 extends between, and is connected for movement therewith, the wheels on the right side of the base. Drive axle 28 has driven sprocket 29 affixed thereto. Roller chain 30 extends between drive sprocket 31, which is connected to hydraulic motor 32, and driven sprocket 29. Hydraulic motor 32 is mounted via a suitable support plate on a vertical support of press 10. By use of a suitable valve, hydraulic fluid can be supplied to motor 32 to rotate drive sprocket 31 in either direction and hence drive axle 28 to move press 10 relative to a rail to be straightened.

The hydraulic system components of reservoir 34, pump 35 and electric motor drive 36 (see FIG. 2) for press 10 are also mounted on base 12 generally on the same side as the hydraulic drive but opposite the tending side and on the rear of the press. The noted hydraulic system not only supplies the power for the hydraulic drive for base 12, and therefore press 10, but also supplies the power for the later to be described pressing components of the press.

The pressing components of press 10 are mounted on vertical support 38. Support 38 includes inwardly facing vertical left and right channels 39 and 40 which are bolted at their lower extremities to base channels 16 and 18. Connecting channels 39 and 40 by suitable fasteners are upper front and rear (see FIG. 2) horizontal channels 41 and 42 and lower front and rear channels 44 and 45.

Figure 3:
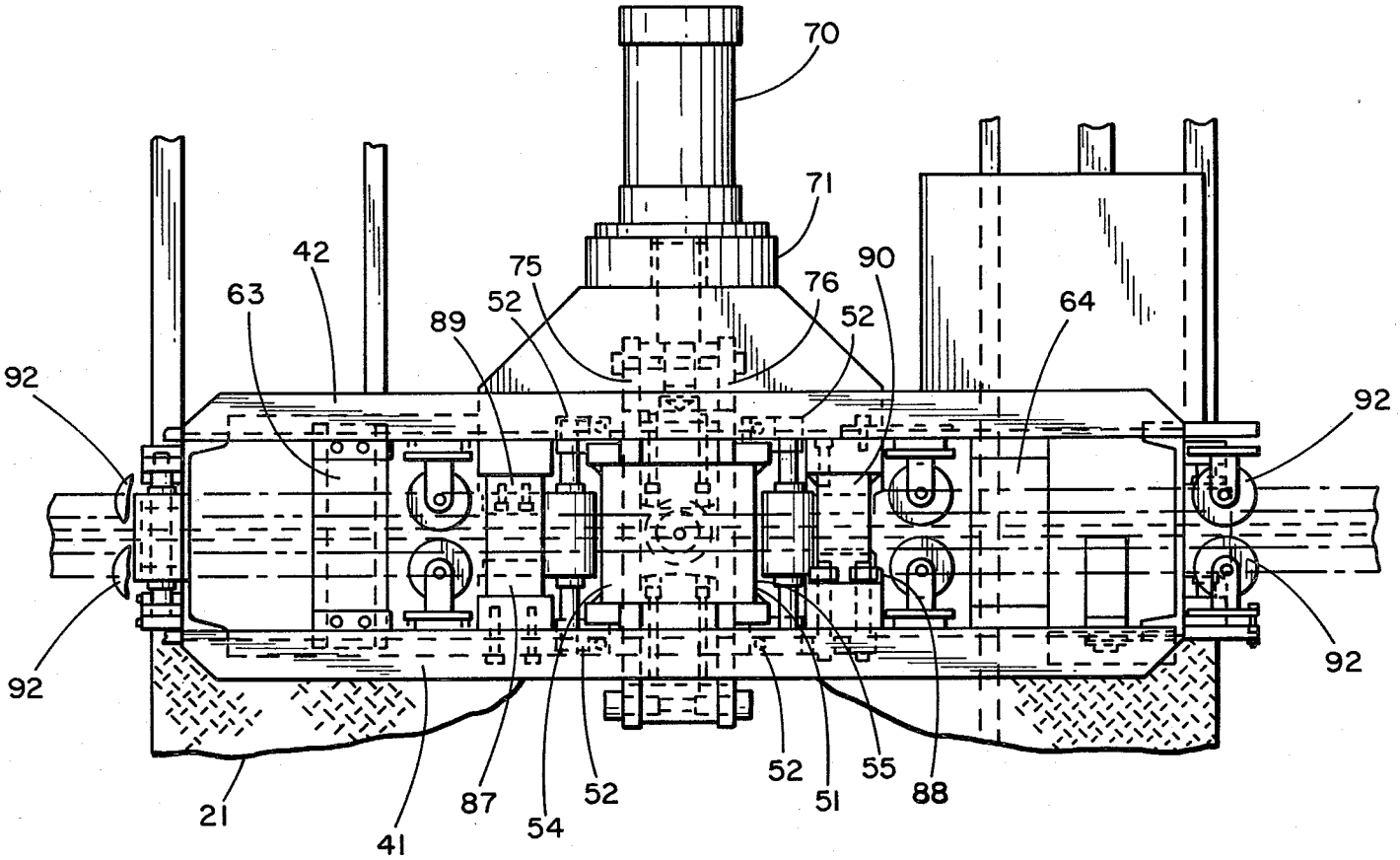
FIG. 3 is a partial plan view (minus the top cylinder) of the press.
Figure 5:
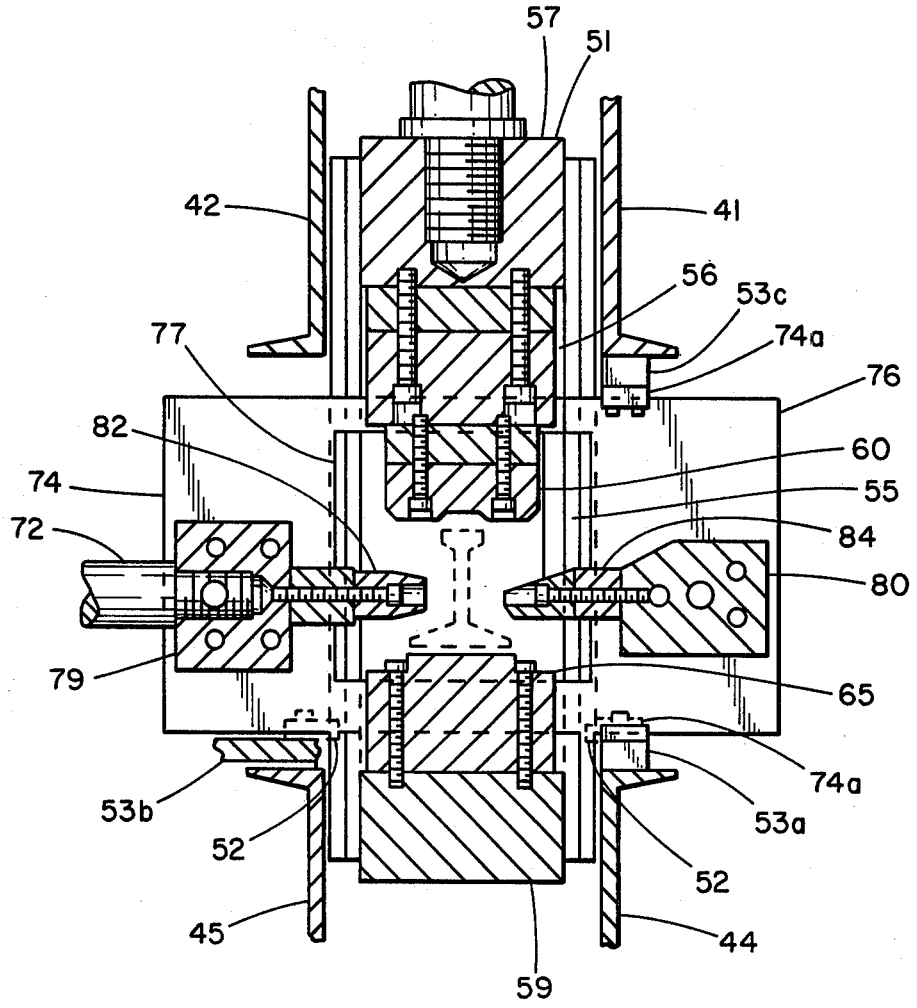
FIG. 5 is an elevational sectional view taken along line 5—5 of FIG. 1.

Vertical pressing assembly 47 is located on top of vertical support 38. Via suitable pads welded to the top of channels 41 and 42, double acting hydraulic cylinder 49 by a base plate is attached to support 38 by suitable capscrews (also see FIG. 3 and FIG. 5). Attached to threaded piston rod 50 of cylinder 49 is vertical cage or housing 51. Cage 51 is slidably supported on universal bearing 52 attached to lower front guide bar **53*a* and support bracket 53*b* which are in turn fastened to front and rear channels 44 and 45. The bearings support the cage movement from a center or neutral position to an upper and lower position depending upon cylinder 49 actuation. Cage 51 has a left side 54 and right 55 when facing the press. Each side has an aperture 56 extending therethrough for travel of the rail to be straightened. Also a part of cage 51 is top side 57 and lower side 59 which are connected to the right and left sides to form a rigid box-like structure. Mounted to top side 57 by suitable fasteners is upper ram 60. Upper ram 60 may include suitable spacers such as 61 for pressing the crown of rails of various sizes in height to be straightened which are mounted in the vertical or upright position in the press. This orientation of the rail requires a larger capacity cylinder for vertical pressing than horizontal pressing. Also associated with vertical pressing assembly 47 are the anvils required for use therewith. Inasmuch as in the pressing process, the crown which was developed in a welding process, when straightened, causes the rail to elongate in a horizontal plane, the rail to be straightened cannot be held tightly. Instead, the press is designed to move the rail downwardly until fixed lower anvils (see FIG. 1) — left anvil 63 and right anvil 64 — mounted on lower channels 44 and 45 are encountered. They provide the spaced supports upon which the rail is straightened when upper ram 60 is moved downwardly by cage 51 attached to rod 50. When rod 50 and hence cage 51 are moved upwardly, lower ram 65 attached to bottom 59 contacts the base of the rail and moves same against the upper anvils (left 66 and right 67**) which straddle the ram and provide support against which the rail is bent to straighten. Preferably suitable spacers are used to provide ajustability for the upper anvils.

Horizontal pressing assembly 69 is mounted on the rear of frame vertical support 38 and opposite the tending side of the press. Assembly 69 includes double acting hydraulic cylinder 70 that is attached via a base plate 71 to support bracket **53*b* and has a threaded piston rod 72 adapted to engage horizontal cage or housing 74 supported by bearings 74*a* 53 and 53*c*. Cage 74 (see FIG. 2 and FIG. 5) has left side 75 and right side 76 with opening 77 extending through both sides. Opening 77 provides space for movement therethrough of the welded rail for straightening. At the rear end of cage 74 is side 79 where rod 72 attaches thereto and a front side 80. The top and bottom of cage 74 are open for the movement therein of upper and lower rams 60 and 65 to contact the rail at preferably the centerpoint of the machine. Rear and front rams 82 and 84** are designed to contact opposing sides of the web of the rail as needed to straighten same. Also an upper portion of each ram is adapted to contact the rail heads (see FIG. 2). The upper portions are vertically adjustable by suitable spacers depending upon the height of the rail to be straightened. Also necessary for horizontal bending are opposed anvils.

Extending between channels 41 and 44 and 45 and 42 and affixed thereto are reinforcements 86. Reinforcements 86 of support bracket **53*b* support front horizontal left and right anvils 87 and 88 mounted thereon and located on the front of the machine. Reinforcements 86 also support rear left and right anvils 89 and 90. Suitable railhead anvils attached thereto, provide support for the railheads in the bending process. Movement of rear horizontal ram 82 forces the rail against anvils (front 87 and 88) to straighten the rail, while movement of horizontal ram 84 moves the rail against rear anvils 89 and 90. Vertically supporting the rail to be straightened, which as mentioned, is moved through the press in a rail head up position, are four spring loaded rollers 91** located on the press. They are located at the left and right sides of the machine and also straddle the press centerlines which are coplanar at the center of the machine. Since, spring loaded, pressing of the rail can occur against the associated anvils without damage to the rollers.

Also provided are spring loaded rollers 92 to maintain the rail web in a centered position in the press except during the pressing process. These horizontally oriented rollers also, by virtue of their spring mounting, do not interfere with the horizontal pressing.

Suitable gauge bars located preferably at the center of the machine at the tending side are utilized to measure the amount of bend and hence the corrective action needed in this manual process. The fixed gauge bars are parallel to the axes of correction from the centerline of the machine and arrows on the movable rams provide an indication on the gauge bars. Observation is readily mode from the tending side of the machine.

Figure 4:
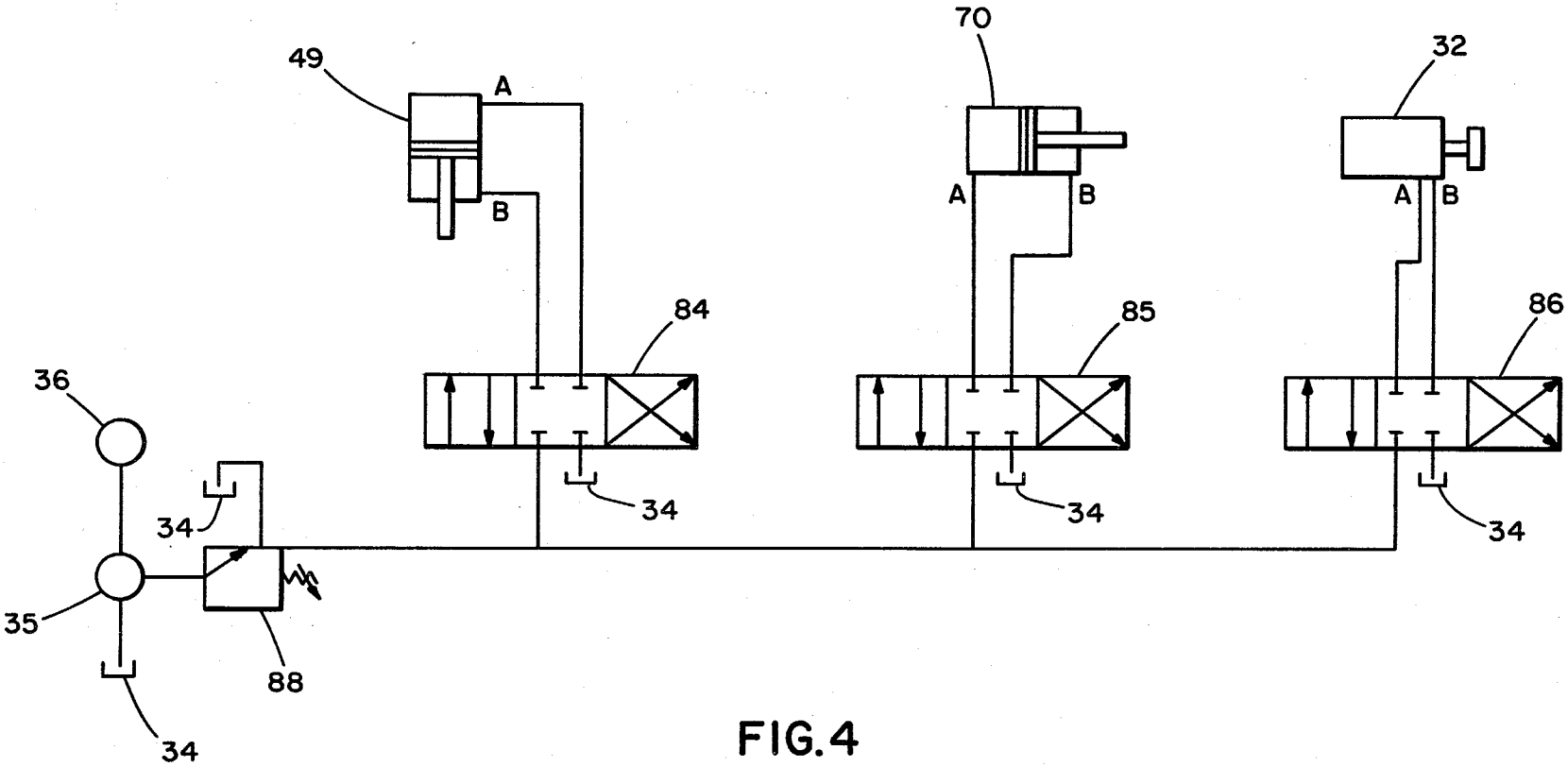
FIG. 4 is a hydraulic diagram for the press.

FIG. 4 discloses the hydraulic circuit for use with rail straightening press with all pressing assemblies in the centered or neutral position and the hydraulic motor inactive. It is to be noted that while the capability of pressing is desired in a horizontal and a vertical plane, pressing is not desired in both planes at the same time as the pressing assemblies would be opposing each other to some extent and also the center lines of force application would be misaligned. Further, the actuation of the hydraulic drive to the wheels of the press base to move same is not desired during pressings. As a consequence, separate but "ganged" valve controls for the hydraulic components located at the tending side are desired along with the switch for actuation of the electric motor drive 36 for pump 35. It is also to be noted that hydraulic cylinder 49 of vertical press assembly 47 and cylinder 70 of horizontal press assembly 69 are to be operated to and fro from a neutral position wherein the straightened rail can be moved relative thereto through the respective cage openings. As a consequence, Applicant utilizes similar valves 84 for cylinder 49, 85 for cylinder 70 and also 86 for motor 32 which are connected in parallel with pressure relief valve 88 connected to pump 35 and to reservoir 34. Valve 84 (as are valves 85 and 86) is a conventional four-way, three position, closed center valve whose piston or spool normally is spring biased to the center position in which all ports are blocked. This valve has a handle, not shown, attached to the valve piston for reciprocation from the central position. A capability of this valve is the "inching" of the associated cylinder piston as desired. Hence, the cylinder piston can be moved from the center or neutral position by visual reference to the associated cage by moving the valve handle as desired to press. Upon completion of the pressing, the handle is moved so that the connected valve piston is moved past center to retract the cylinder piston, and when the associated cage reaches center, the handle is released with the spring returning same to center, closing all ports and stopping the cylinder piston. Thus, the piston of each cylinder can be used for pressing in both directions from a central position manually without means for controlling cylinder piston location. Valve 86 performs a similar function with hydraulic motor 32 thus providing selective location of press 10 relative to the rail to be straightened. Of course, the entire procedure could be easily automated by suitable "bend" sensors and controls if desired.

In operation, a rail that has been welded in a welding machine is advanced preferably from the right of the rail press as shown in FIG. 1 over adjacent spring loaded roller 91 and into the press over similar spring loaded rollers. The rails stands in an upright position with rail head up. If need be the operator, by virtue of the handle of valve 86 can move press 10 via wheels 22 and the hydraulic drive to position the press as desired in regard to the rail weld. The operator compares the area of the rail at the weld with a gauge while standing on the deck of the press at the tending side adjacent the weld. If an upward rail crown is noted, he actuates the handle of valve 84 in one direction from its center to cause rod 50 of cylinder 49 and thus cage 51 to move from a neutral position, wherein the rail is free to move through aperture 56 in the cage, downward. Upper ram 60 contacts the rail and moves it down against lower spaced anvils 63 and 64 to straighten the rail which ends are free to move longitudinally. The spring loaded support rollers 91 are free to compress. Upon completion of the straightening process, which may require several piston strokes, the operator moves the handle in the opposite direction, past the central or neutral valve piston position, and releases whereby the spring centers the valve piston and closes all ports which stops the cage at its center position as desired. The rail is free then for movement through the cage aperture 56. If a downward rail bend is noted, the handle is moved in a contrary fashion to cause cage 51 to move upwardly to cause lower ram 65 to move the rail against the upper anvils 66 and 67 to straighten the rail. The upper anvils, as mentioned, have movable spacers to accommodate varying height rails.

Should the rail have a bend in a horizontal plane, the operator, on detecting same with reference to the gauge, operates the handle of valve 85 (if the bend is toward the rear of the press) to actuate cylinder 70 via rod 72 to move cage 74 horizontally until rear ram 82 contacts the rail to move same against front anvils 87 and 88 also depressing spring loaded support rollers 92. Contrary movement of cage 74 forces ram 84 against rear anvils 89 and 90 to straighten an opposed bend.

It is to be noted that for efficient press load application, each load is applied by each cage at the machine centerline. Thus the rams of the vertical cage must extend down into the centered, horizontal cage to bend the rail therein in a vertical direction. Of course this center location of the cages and cylinders also makes measuring and operation of the press at the press centerline possible and provides space for a tending side at this location. All components of the press are located thereon and the press can be moved as desired along the rail as needed to straighten same.

Having thus described the invention it will be apparent to those skilled in the art that various changes and modifications can be made without departure from the spirit of the invention or the scope of the appended claims.

I claim:

1. A rail straightening press comprising: a support structure; a housing slidably mounted on said structure, said housing having an opening therethrough for the rail, said housing having a pair of opposing rams mounted thereon, said rams being located on opposite sides of said opening; a first pair of spaced anvils mounted on said structure and straddling a ram; a second pair of spaced anvils mounted on said structure and straddling the other ram; means connected to a side of said housing adjacent a ram for reciprocating said housing to force a ram against the rail, and the rail against said first pair of anvils to straighten the rail on movement of said housing in one direction, and to force the other ram against the rail, and the rail against the second pair of anvils to straighten the rail on movement in an opposite direction; a second housing slidably mounted on said structure, said second housing having an aperture therethrough for the rail, said second housing surrounding said first housing and having a second pair of opposed rams mounted thereon, said rams being located on opposite sides of said aperture, said second pair of rams extending inside said first housing; a third pair of spaced anvils mounted on said structure and straddling a first ram of said second pair of rams; a fourth pair of spaced anvils mounted on said structure and straddling a second ram of said second pair of rams; and second means connected to a side of said second housing adjacent a first ram of said second pair of rams for reciprocating said housing to force said first ram against the rail and against the third pair of anvils on movement in one direction to straighten the rail and said second ram against the rail and the fourth pair of anvils on movement in another direction.

2. The press of claim 1 in which the first and second housings move in directions transverse to each other.

3. The press of claim 2 in which said first and second means are hydraulic cylinders mounted on said structure.

4. The press of claim 3 in which said first and second cylinder pistons are located in the center of each cylinder for reciprocation in either direction therefrom.

5. The press of claim 4 in which said first housing is located in a horizontal plane and transverse to the rail and said second housing is located in a vertical plane and transverse to the rail.

6. The press of claim 5 in which said structure is mounted for movement on a pair of railroad rails.

7. The press of claim 6 further including means to drive said structure along said track.

* * * * *